United States Patent [19]

Reetz

[11] Patent Number: 4,957,186

[45] Date of Patent: Sep. 18, 1990

[54] SPAN-ADJUSTABLE OPEN-WEB SUPPORT BRACKET

[75] Inventor: William R. Reetz, Boise, Id.

[73] Assignee: T J International, Inc., Boise, Id.

[21] Appl. No.: 448,323

[22] Filed: Dec. 11, 1989

[51] Int. Cl.[5] ..... E04H 12/18; E04C 3/292

[52] U.S. Cl. ..... 248/296; 248/298; 52/632

[58] Field of Search ..... 248/298, 291, 296, 299; 52/632, 633

[56] References Cited

U.S. PATENT DOCUMENTS

| | | | |
|---|---|---|---|
| 3,123,185 | 3/1964 | Rijst | 52/633 |
| 3,325,957 | 6/1967 | Demeules | 52/632 |
| 3,954,248 | 5/1976 | Barber | 52/632 |
| 4,682,460 | 7/1987 | Reetz | 52/632 |
| 4,745,724 | 5/1988 | Reetz | 52/632 |

*Primary Examiner*—Reinaldo P. Machado

*Attorney, Agent, or Firm*—Kolisch, Hartwell & Dickinson

[57] ABSTRACT

A span-adjustable open-web support braket is intended for use in a truss having an upper chord member with a slot in an end thereof, a lower chord member, and a plurality of spaced web members interconnecting the chord members. The bracket includes a length-adjustment mechanism which is attached adjacent the end of the upper chord for adjusting in the length of the upper chord. A web-member length adjustment mechanism is attached to a web member adjacent the chord-length-adjustment-mechanism. An interlock is disposed between the mechanisms for coordinating chord length and web-member length adjustments.

20 Claims, 3 Drawing Sheets

SPAN-ADJUSTABLE OPEN-WEB SUPPORT BRACKET

BACKGROUND OF THE INVENTION

The instant invention relates to a support bracket for a structural truss and specifically to such a bracket which is capable of adjusting the span length of a truss.

Open web trusses are used in the construction of buildings, and typically include an upper chord, generally formed of solid dimensional lumber or of laminated veneer lumber (LVL), a lower chord formed of similar material, and an open web, generally formed of steel tubing which extends between the upper and lower chords.

Once the plans for a building structure have been approved, trusses are ordered in specific dimensions and are prefabricated to those dimensions at a manufacturing site. In some instances, the building may not be constructed to the exact dimensions as are set forth in the plans. In such situations, it is necessary to modify the dimensions of the trusses in the field, in the case where the joists are too long, or to reorder additional trusses in the event they are too short. Both of these situations result in additional time and potential additional costs.

U.S. Pat. No. 4,682,460, for an OPEN WEB STRUCTURAL SUPPORT MOUNTING BRACKET AND LENGTH ADJUSTABLE WEB MEMBER, and U.S. Pat. No. 4,745,724, for OPEN WEB STRUCTURAL SUPPORT MEMBER OF ADJUSTABLE LENGTH WITH INCREMENTAL ADJUSTMENT OF END WEB MEMBER, both address the above-identified problem. However, the bracket of the U.S. Pat. No. 4,682,460 patent provides a rather complicated extension for a web member, while the support member of the U.S. Pat. No. 4,745,724 provides adjustment only in predetermined increments.

It is an object of the present invention to overcome the drawbacks and limitations with the prior art proposals. More specifically, the invention has its objects, one or more of the following:

(1) to provide a support bracket which is infinitely adjustable within a predetermined range;

(2) the provision of a support bracket which may be easily installed in an open web truss and which provides for adjustment for both web and chord lengths while maintaining full structural supporting capability;

(3) to develop a support bracket which locks up when a vertical load is applied to the truss; and (4) to provide a support bracket which is easily adjustable on-site, and which does not require extensive removal and reinstallation of components.

SUMMARY OF THE INVENTION

The span-adjustable open-web support bracket of the invention is intended for use in a truss having an upper chord member with a slot disposed adjacent an end thereof, a lower chord member, and a plurality of spaced web members interconnecting the chord members. The bracket includes a length-adjustment mechanism which is mounted to an end of the upper chord to provide adjustment in the length of the chord. A web-member length adjustment mechanism is attached to a web member located adjacent the chord-length-adjustment-mechanism. An interlock mechanism is located between the two mechanisms for coordinating chord length and web-member length adjustments.

These and other objects and advantages of the invention will become more fully apparent as the description which follows is read in conjunction with the drawings.

DETAILED DESCRIPTION OF THE PREFERRED EMBODIMENTS

Figure 1:
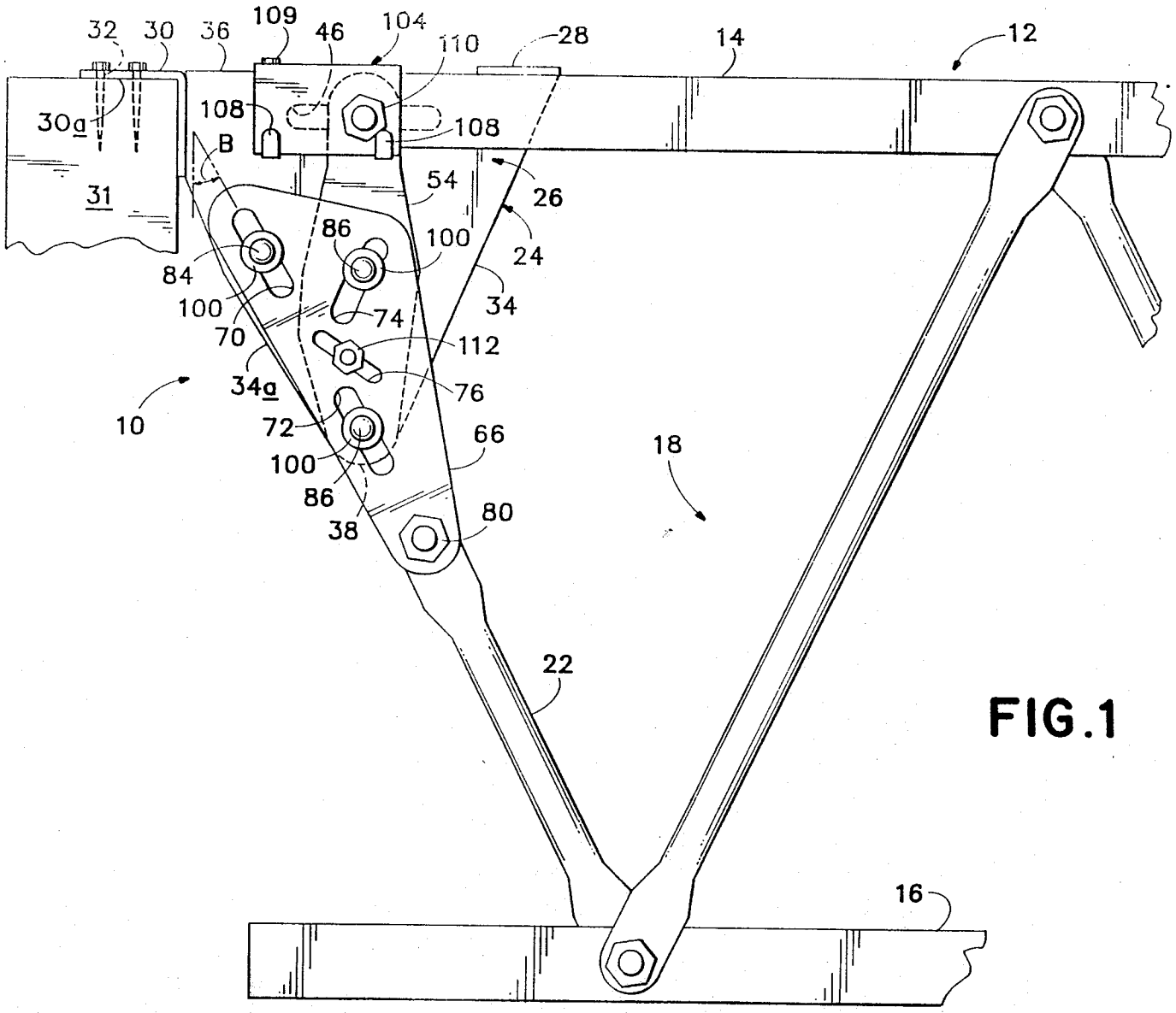
FIG. 1 is a side elevation environmental view of the support bracket of a first embodiment of the invention.
Figure 2:
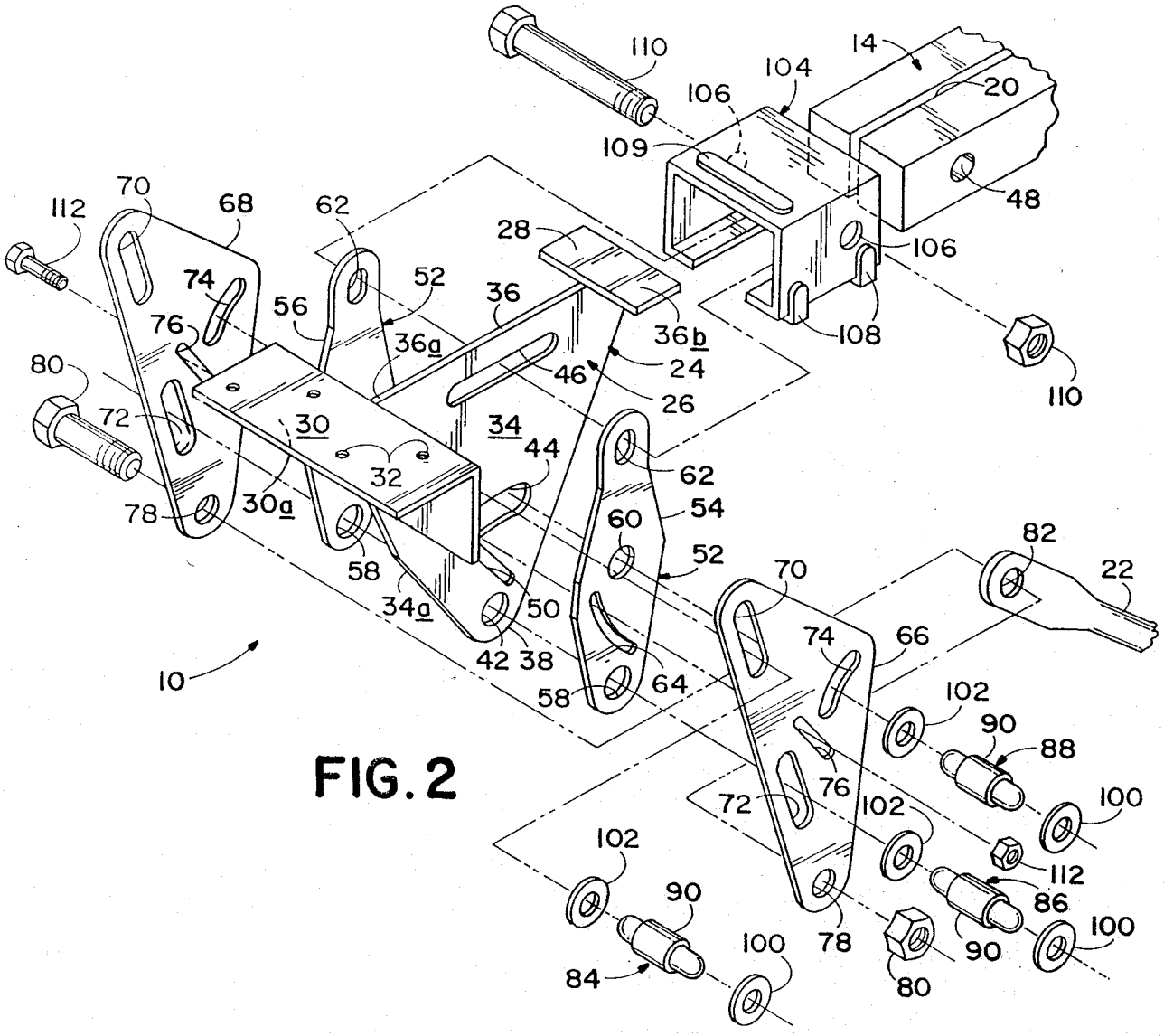
FIG. 2 is an exploded perspective view of the support bracket of FIG. 1.

Turning now to the drawings, and initially to FIGS. 1 and 2, a span-adjustable open-web support bracket constructed according to the invention is shown generally at 10. Bracket 10 is mounted on one end of an open web truss 12 which includes an upper chord 14, a lower chord 16 and an open web 18 extending between the upper and lower chords. Chords 14 and 16 may be formed of dimensional lumber, but more often they are formed of laminated veneer lumber (LVL). Upper chord 14 has a longitudinally extending slot 20 formed in the end thereof which extends vertically through the height that chord.

Web 18 is formed of a plurality of tubular metal members, each of which has flattened ends, which are received in apertures formed in chords 14 and 16. Bracket 10 is received in slot 20 in upper chord 14 and is attached to an end web member 22, which extends upwardly from lower chord 16. Bracket 10 includes a bearing assembly 24 having a bearing plate 26, a bearing pad 28 and a bearing angle 30. Bearing pad 28 and bearing angle 30 are typically welded to bearing plate 26. Bearing angle 30 includes a bearing surface **30*a* which provides a rest, or support, for placement of the truss over a supporting beam 31 (see FIG. 1). A number of bores 32 are provided in bearing angle 30 to allow passage of fasteners, such as nails, to pass through angle 30 into supporting beam 31. Bearing pad 28 rests on the upper surface of upper chord 14**.

Bearing plate 26, in the preferred embodiment, has a substantially triangularly-shaped web 34. Web 34 includes an upper edge 36 and an apex 38. As best seen in FIG. 2, one end **36*a* of upper edge 36 receives bearing angle 30 thereon, while bearing pad 28 is attached adjacent the other upper end 36*b* thereof. In this embodiment of the bearing assembly, upper edge 36 is located in a parallel relationship to bearing surface 30*a***.

A pair of in-line bores, including an upper in-line bore 40 and lower in-line bore 42, are located in web 34, and form what is referred to herein as a web-member extension path. Lower in-line bore 42 is located adjacent apex 38 of web 34. A first arcuate registration slot 44 is located in web 34 intermediate apex 38 and upper edge 36. An elongate slot 46 is located adjacent top edge 36 and is aligned with a bore 48 (FIG. 2) formed in upper chord 14. In the preferred embodiment, a lock slot 50 is located between arcuate slot 44 and lower in-line bore 42.

An arm mechanism 52 includes a pair of elongate arm structures 54, 56, positioned on each side of bearing plate web 34. Each arm structure has a lower bore 58 which is aligned with lower in-line bore 42. A registration bore 60 is located intermediate the ends of each arm structure and is alignable with first arcuate registration slot 44 in web 34. Each arm structure has a substantially vertically extending slot 62 located at the upper end thereof, which is partially aligned with horizontally disposed elongate slot 46, and with bore 48 when bracket 10 is assembled. A curved lock slot 64 is located intermediate lower bore 58 and registration bore 60. Bearing assembly 24 and arm mechanism 52 comprise what is referred to herein as chord-length adjustment mechanism.

Web plates 66, 68 are located on each side of bearing plate web 34 and, in the preferred embodiment, are located external of the arm mechanism 52. The web plates have a generally irregular triangular shape and include a pair of in-line slots, including an 10 upper in-line slot 70 and a lower in-line slot 72. The in-line slots are located adjacent a side, or base, such as **66*a*, and extend parallel thereto. The in-line slots are aligned with the in-line bores 40 and 42 of bearing assembly 24. Each of the web plates 66, 68 include a second arcuate registration slot 74 and a lock slot 76. A bore 78 is provided adjacent one end of the base of the web plate and receives a fastener 80 which extends through bore 78 and a bore 82 in the end of web member 22 (FIG. 2), for securing the web plates to web member 22. Web plates 66, 68** are also referred to herein as a web-member length adjustment mechanism.

An interlock is located between the bearing assembly 24, arm mechanism 52 and web plates 66, 68 and coordinates chord length and web-member length adjustments. The interlock includes several pins, such as pins 84, 86 and 88.

Figure 5:
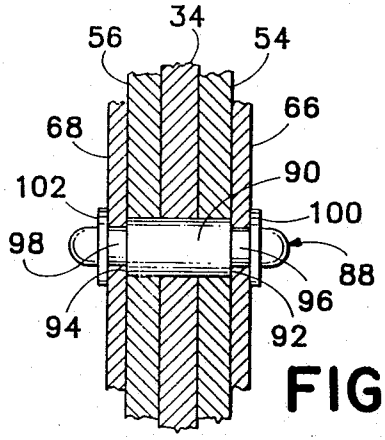
FIG. 5 is an end elevation sectional view taken generally through line 5—5 of FIG. 4.

The pins, now referring to FIG. 5, include a body 90, a pair of opposed, spaced apart first shoulders 92, 94, each of which has a flattened side thereon, and a second shoulder 96, 98. Compression washers 100, 102 are received on second shoulders 96, 98, respectively, and serve to hold the components of the support bracket together.

Pin 84 extends through upper in-line base 40 in web 34, and upper in-line slots 70 in web plates 66, 68. The body 90 of pin 84 is positioned in bore 40. At the location of pin 84, a gap exists between web 34 and web plates 66, 68. The space is maintained by the thickness of arms 54, 56. Compression washer 102, 104 ride on the outer surface of web plate 66, 68 to maintain support bracket 10 in an assembled condition.

Pin 86 is carried in lower in-line bore 42 and extends through lower bore 58 in arm structures 54, 56 and lower in-line slot 72 in web plate 66, 68. Thus, web plates 66, 68 are slidably carried on the bearing assembly as the web plates are free to slide along the length of slots 70, 72. Pin 86 also extends into each of the arm structures and provides for rotational movement of the arm structure about the pin. Pins 84 and 86 are also referred to herein as extension path pins.

Pin 88 is carried in bearing assembly first arcuate registration slot 44, extends through registration bore 60 in each of the arm structures 54, 56 and into second arcuate registration slot 74 in each of the web plates 66, 68.

Figure 4:
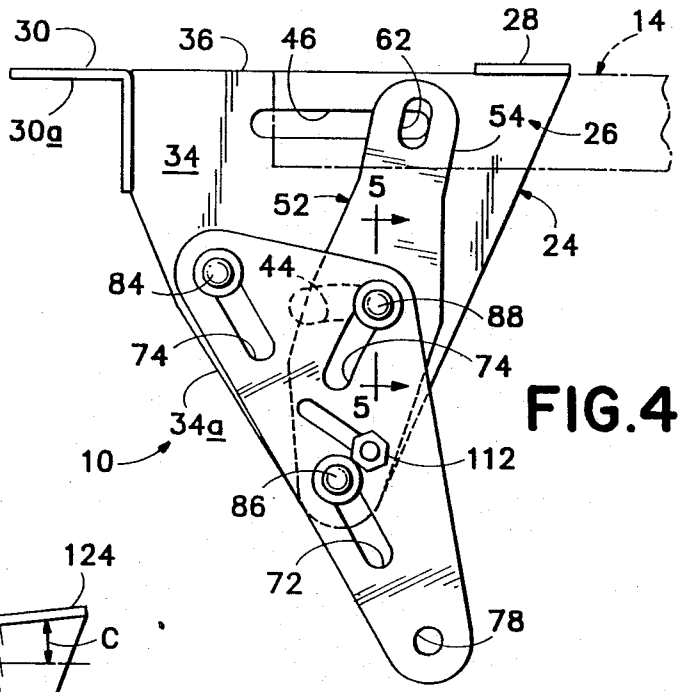
FIG. 4 is a side elevation view of the support bracket of FIG. 1, shown in a fully extended position.
Figure 3:
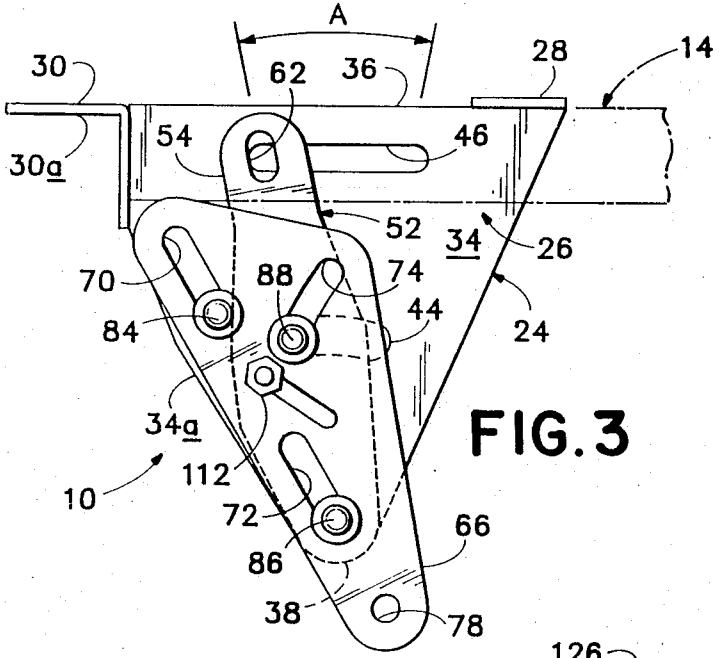
FIG. 3 is a side elevation view of the support bracket of FIG. 1, shown a fully retracted position.

Referring now to FIGS. 3 and 4, it may be seen that as the arm mechanism 52 is tilted to the left, the web plates 66, 68 are drawn upward alongside of web 34 which effects a shortening of the distance between bearing angle 30 and bore 78, thereby effectively shortening web member 22. Additionally, as the arm mechanism 52 is shifted toward the left, vertically disposed slot 62 moves left and, in order to maintain registration with bore 48 in upper chord 14, the upper chord is drawn into bearing assembly, thereby effectively shortening the length of upper chord 14.

Referring now to FIG. 4, the arm mechanism has been tilted to the right, resulting in an extension of web plates 66, 68 to their full length, positioning the bearing assembly in a fully extended position. It may be seen that the construction of support bracket 10 is capable of adjusting the length of the chord and the web member, and that the interlock mechanism, including the pins and the various slots and bores in the components of the support bracket, is operable to coordinate proportional chord length and web-member length adjustments.

Referring now to FIGS. 1 and 2, the final component of the support bracket is a bearing clip 104 which is sized to be clearance fittable over upper chord 14. Bearing clip 104 has a substantially C-shaped cross section and includes bores 106 which are located on each side of the clip and which are aligned with bore 48 in upper chord 14. A fastener 110 is placed through bores 106 in the clip, bore 48 in the chord, and slots 46 and 62 in the bracket, to retain the bracket on the end of the chord and, when the bracket is properly positioned, to secure the bracket in place. Clip 104 is typically formed of twelve gauge galvanized steel, and is formed with reinforcing gussets 108 on the lower margins of the sides thereof, which extend into the flanges on the lower surface thereof. Also included is a reinforcing gusset 109 on the upper portion of clip 104.

During the construction process, the truss containing the support bracket of the invention is moved into its desired position, and the support bracket is adjusted with the truss in a no-load condition. Bracket adjustment takes place with fastener 110 in a loose condition so that the bearing assembly may be easily moved along the axis of chord 14. Arm structures 54, 56 are free to move though an arc which is approximately 10 degrees (angle A, FIG. 3). This provides, depending upon the overall size of support bracket 10, an adjustment of 2 to 4 inches in the length of chord 14. The bearing is adjusted when no load is on the truss by pulling or pushing the bearing angle to the desired span position. As this action takes place, the end web member 22 automatically adjusts to the proper length by means of arm structures 54, 56 moving web plates 66, 68 to the proper position. Once the bracket is properly adjusted so that bearing angle 30 is securely in contact with a support member, a nut and bolt combination 112 is inserted in the look slots 50, 64 and 76, and tightened to provide a positive seismic tie-load capability between the chords and the interconnecting, open web 18. Nails, or other suitable fasteners 10 may then be applied through bores 32 in bearing angle 30 and into supporting beam 31, and fastener 110 is cinched down to positively lock bearing clip 104, arms structures 54, 56 and bearing assembly 24 into place.

Bearing clip 104 is provided to assist in distributing the vertical panel load of the top chord to the support bracket. Support bracket 10 is designed with a "neutral" web angle that is 30 degrees from vertical, i.e., with the support bracket in its neutral position, as depicted in FIG. 1, an extension of end web member 22 meets a vertical line at a 30 degree angle (angle B). With the support bracket in its neutral position, there is no eccentricity in the components of support bracket 10. This provides that all of the load is carried at the junction between bearing assembly 26 and chord member 14. When the support bracket is subjected to loads on bearing assembly 24 at web angle other than 30 degrees, which may extend between 25 and 35 degrees, in the preferred embodiment, torsional forces are applied to bearing assembly 24 which tend to rotate it about fastener 110. This action is resisted by the combination of bearing clip 104 and bearing pad 28, both of which react against chord 14.

Figure 6:
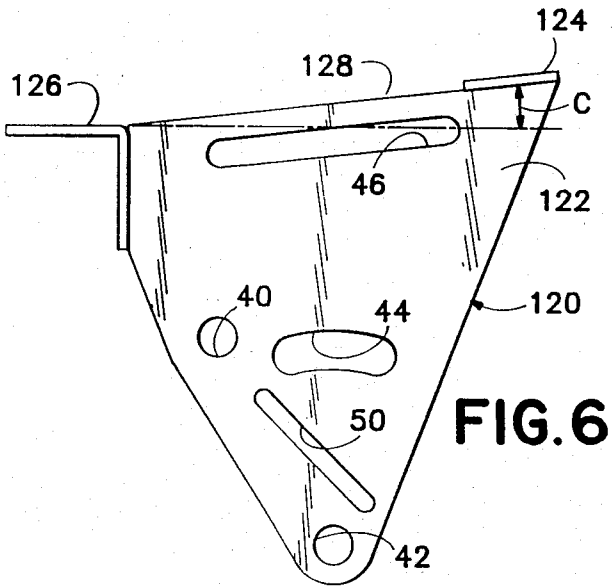
FIG. 6 is a side elevation view of a modified form of a bearing assembly of the invention.

Referring now to FIG. 6, a modified form of the bearing assembly is depicted generally at 120. Bearing assembly 120 includes a bearing plate 122, a bearing pad 124, a bearing angle 126, and the bores and slots as are present in bearing plate 26, and which are identified by like reference numbers. Bearing assembly 120 is intended for use Where a truss must be installed in a sloping orientation. To this end, the upper or top, edge 128 of bearing assembly 120 is sloped to conform with the desired angle orientation of the truss. Angle C may have a value of between 0 and 5 degrees.

Thus a span-adjustable, open-web support bracket has been disclosed which provides for infinite span adjustment of the truss within a limited range without requiring complete disassembly of the support bracket during the adjustment proceeding. The support bracket includes an interlock which automatically adjusts the length of the web member to which the bracket is attached while simultaneously adjusting the length of the chord member to which the bracket is attached. Although a preferred embodiment of the invention, and a modification thereof have been disclosed, it should be appreciated that other variations and modifications may be made thereto without departing from the scope of the invention as defined in the appended claims.

What we claim is:

1. A span-adjustable open-web support bracket for use in a truss having an upper chord member with a slot in an end thereof, a lower chord member, and a plurality of spaced web members interconnecting the chord members, the bracket comprising:

a chord-length adjustment mechanism attached adjacent the end of the upper chord for adjusting the length of the upper chord;

a web-member length adjustment mechanism attached to a web member adjacent the chord-length adjustment-mechanism; and an interlock located between the mechanisms for coordinating chord length and web-member length adjustments.

2. The bracket of claim wherein the chord-length adjustment mechanism includes a bearing assembly which is secured to a truss support, the assembly including a bearing plate slidably received in the slot and having an elongate upper edge, a bearing angle attached to the bearing plate adjacent one upper end thereof and a bearing pad attached to the bearing plate adjacent the other upper end thereof, the bearing angle including a bearing surface thereon for contacting a truss supporting element.

3. The bracket of claim 2 wherein the upper edge of the bearing plate is parallel to the bearing surface.

4. The bracket of claim 2 wherein the upper edge of the bearing plate is angled relative to the bearing surface at an angle of no more than five degrees.

5. The bracket of claim 2 wherein the interlock includes plural bores and plural slots located in the bearing plate, plural slots located in the web-member-length adjustment mechanism, at least two of which are alignable with two of the bores in the bearing plate, and which further includes an arm mechanism having plural bores and an arcuate slot therein, and plural pins carried in the bores and the slots to provide alignment of the bearing plate, the web-member-length adjustment mechanism and the arm mechanism such that the chord-length adjustment mechanism and the web-member-length adjustment mechanism are adjusted in proportionate lengths.

6. A span-adjustable open-web support bracket for use in a truss having an upper chord member with a vertically disposed slot at an end thereof and a horizontally disposed bore extending laterally through the upper chord adjacent the end thereof, a lower chord member, and a plurality of spaced web members interconnecting the chord members, the bracket comprising:

a bearing assembly including a bearing plate with a web including a top edge, the web having plural bores therein which define a web-member extension path, the web further having an arcuate slot therein;

a pair of elongate arm structures extending along each side of the bearing plate web, each arm structure having plural bores therein with one of the bores being located at a bottom end of the structure and alignable with a bore in the bearing plate web and another of the bores being located intermediate the ends of the structure and alignable with the arcuate slot in the bearing plate web;

a pair of external plates having plural slots arranged along a line which is collinear with the web-member extension path and an arcuate slot which is alignable with the arcuate slot in the bearing plate web, and including a connector for connecting the external plates to a web member; and plural extension path pins carried in said bearing plate web, one of the pins extending into one bore in the arm structure and into one of the slots in the external plates, another pin extending into the other slot in the external plate, and another pin carried in the arcuate slot in the bearing plate web and extending into the intermediate bore in the arm structure and the arcuate slot in the external plates, the pins providing a registration between the bearing plate, the arm structure and the external plates providing proportional length adjustment of the upper chord member and web members.

7. The bracket of claim 6 wherein the bearing plate web, the arm structures and the external plates all include a lock slot therein for locking the aforementioned components in a fixed relationship when the bracket is adjusted to its final dimensions.

8. The bracket of claim 6 wherein the bearing assembly further includes a bearing angle located at one end of the bearing plate web top edge, the bearing angle including a bearing surface for contacting a truss supporting element, and a bearing pad located at the other end of the web top edge and wherein the bearing plate web is received in the slot in the upper chord with the bearing pad resting on the upper surface of the upper chord.

9. The bracket of claim 8 wherein the top edge of the bearing plate is parallel to the bearing surface.

10. The bracket of claim 8 wherein the top edge of the bearing plate is angled relative to the bearing surface at an angle of no more than five degrees.

11. The bracket of claim 6 which further includes a bearing clip having a substantially C-shaped cross-section which is sized to be clearance fittable over the end of the upper chord wherein the clip has a bore extending through opposed sides which is alignable with the bore in the upper chord, and wherein the bearing plate web has a slot extending parallel to the upper edge therein which is aligned with the bore in the upper chord, and wherein the arm structures have a slot extending parallel to the major axis thereof adjacent the other end thereof which is also aligned with the bore in the upper chord, and a fastening mechanism extending through the aforementioned bores and slots to secure the bearing clip, the bearing plate web and the arm structure in a fixed position relative to the upper chord.

12. A span-adjustable open-web support bracket for use on a truss having an upper chord member including a vertically disposed slot in an end thereof and a bore extending laterally therethrough adjacent the end thereof, a lower chord member, and a plurality of spaced web members interconnecting the chord members, the bracket comprising:

a chord-length adjustment mechanism attached adjacent the end of the upper chord for adjusting the length of the upper chord, including a bearing assembly and an arm mechanism;

a web-member length adjustment mechanism attached to a web member located adjacent the end of a chord-length-adjustment mechanism bearing chord, including a pair of web plates which are slidably carried in the bearing assembly; and an interlock located between the chord-length adjustment mechanism and the web-member-length adjustment mechanism for coordinating chord length and web-member length adjustments.

13. The bracket of claim 12 wherein the arm mechanism includes a pair of elongate arm structures which are positioned on each side of the bearing plate with one of the arm structures located at the apex of the web and the other end of the arm structure extending upwardly into the slot in the upper chord member.

14. The bracket of claim 12 wherein the web plates are positioned on each side of the bearing plate web and externally of the arm mechanism, and wherein the web plates are shiftable along a side of the bearing plate as the bearing plate shifts within the slot in the upper chord member.

15. The bracket of claim 12 wherein the interlock includes plural pins carried in the bearing assembly and extending into the arm mechanism and the web plates for coordinating relative motion of the bearing assembly, arm mechanism and web plates, the bearing assembly including a bearing plate having a base located at the top thereof and a downwardly depending apex, and having a pair of in-line bores located adjacent one side of the web, with one of the in-line bores being located adjacent the apex of the web, a first arcuate registration slot located intermediate the apex and the top edge, and an elongate slot located adjacent the top edge, parallel thereto and aligned with the bore in the upper chord member, the arm mechanism including a pair of elongate arm structures located on each side of the bearing plate web, each arm structure having a lower bore located at one end thereof, a registration bore located intermediate the ends thereof, and a slot located adjacent the other end thereof, the web plates being located on each side of the bearing plate web external of the arm structures and having a generally irregular-triangular shape including a pair of in-line slots located adjacent and parallel to the base thereof which are aligned with the in-line bores of the bearing plate web, a second arcuate registration slot, and a bore for receiving a fastener to secure the web plates to a web member, two of the pins being carried in the in-line bores in the bearing plate web and extending through the in-line slots in the web plates providing for relative linear motion between the bearing plate web and the web plates, the pin located adjacent the web apex also extending through the lower bore in the arm structures, providing for rotational movement of the arm structures about the pin, a third pin which is carried in the first arcuate registration slot and which extends through the registration bore and the second registration slot to provide alignment of the bearing plate web, the arm mechanism and the web plates such that the bearing plate and the web plates are adjusted in proportionate lengths to provide an upper chord of the desired dimensions, and a fastener which extends through the bearing plate web elongate slot, the slot in the arm structures and the bore in the upper chord member for securing the relative positions of the bearing plate, arm structures and the web plates.

16. The bracket of claim 15 wherein the bearing plate web, the arm structures and the external plates all include a lock slot therein for locking the aforementioned components in a fixed relationship when the bracket is adjusted to its final dimensions.

17. The bracket of claim 15 wherein the bearing assembly further includes a bearing angle located at one end of the bearing plate web base, the bearing angle including a bearing surface thereon for contacting a truss supporting element, and a bearing pad located at the other end of the bearing plate web base, and wherein the bearing plate web is received in the slot in the upper chord with the bearing pad resting on the upper surface of the upper chord.

18. The bracket of claim 17 which further includes a bearing clip having a substantially C-shaped cross-section sized to be clearance fittable over the end of the upper chord at the end thereof, wherein the clip has a bore extending through opposed sides thereof which is alignable with the bore in the upper chord for receiving the fastener therethrough.

19. The bracket of claim 15 wherein the base of the bearing plate is parallel to the bearing surface.

20. The bracket of claim 15 wherein the base of the bearing plate is angled relative to the bearing surface at an angle of no more than five degrees.

* * * * *